US007089087B2

(12) United States Patent
Dudley

(10) Patent No.: US 7,089,087 B2
(45) Date of Patent: Aug. 8, 2006

(54) LIMITED ACCESS COMFORT CONTROL

(75) Inventor: Kevin F. Dudley, Cazenovia, NY (US)

(73) Assignee: Carrier Corporation, Farmington, CT (US)

( * ) Notice: Subject to any disclaimer, the term of this patent is extended or adjusted under 35 U.S.C. 154(b) by 865 days.

(21) Appl. No.: 10/147,401

(22) Filed: May 17, 2002

(65) Prior Publication Data

US 2003/0217143 A1 Nov. 20, 2003

(51) Int. Cl.
*G01M 1/38* (2006.01)

(52) U.S. Cl. ..... 700/276; 236/1 B

(58) Field of Classification Search ..... 700/276–278
See application file for complete search history.

(56) References Cited

U.S. PATENT DOCUMENTS 5,156,203 A * 10/1992 Funakoshi et al. ..... 165/207
5,170,935 A * 12/1992 Federspiel et al. ..... 236/44 C
5,615,134 A * 3/1997 Newsham et al. ..... 700/276
5,682,949 A * 11/1997 Ratcliffe et al. ..... 165/209
5,762,265 A * 6/1998 Kitamura et al. ..... 236/51
5,927,398 A * 7/1999 Maciulewicz ..... 165/209
5,971,597 A * 10/1999 Baldwin et al. ..... 700/277
6,098,893 A * 8/2000 Berglund et al. ..... 236/51
6,145,751 A * 11/2000 Ahmed ..... 236/51
6,241,156 B1 * 6/2001 Kline et al. ..... 236/49.3
6,366,832 B1 * 4/2002 Lomonaco et al. ..... 700/276
6,510,212 B1 * 1/2003 Ito et al. ..... 379/102.03

* cited by examiner

*Primary Examiner*—Leo Picard
*Assistant Examiner*—Chad Rapp
(74) *Attorney, Agent, or Firm*—Wall Marjama & Bilinski LLP

(57) ABSTRACT

A data collection system allows occupants in one or more locations to provide indications as to their respective levels of comfort. The indications as to comfort level are preferably provided through personal computers in these locations. Each computer is programmed to display a menu of comfort level options that may be selected by the user of the computer. Each computer is operative to require that any selected comfort level be accompanied by a verification as to the user making the one or more selections. The verification preferably requires an entry of an identification that may be checked against a stored identification. Each computer is operative to timely provide the selections as to comfort level by a recognized user to a network computer. The network computer is operative to analyze the comfort level information from these computers and send one or more commands to an HVAC system providing conditioned air to the locations.

18 Claims, 5 Drawing Sheets

LIMITED ACCESS COMFORT CONTROL

BACKGROUND OF THE INVENTION

This invention relates to the gathering of information from locations to be provided with conditioned air by one or more HVAC systems.

The gathering of information from locations in which conditioned air is to be provided has heretofore been largely accomplished through the use of thermostats. These thermostats typically allow an individual to enter a preferred set point temperature indicative of the level of comfort that he or she desires. The thermostat also typically includes a sensor for sensing the actual temperature in the room. The difference between the entered setpoints and sensed temperatures are used to control one or more HVAC systems providing conditioned air to the locations.

There may be several people in a location that would have different feelings as to what the set point temperature should be. Individual thermostats do not allow these people to each individually provide their respective feelings of comfort. There is also no ability to identify who is requesting a particular level of comfort at a particular location.

SUMMARY OF THE INVENTION

A data collection system allows individual occupants in one or more locations to provide an indication as to their respective levels of comfort. The indications as to comfort level are preferably provided through personal computers in these locations. Each computer is programmed to display a menu of comfort level options that may be selected by the user of the computer. Each computer is operative to also request that the user enter an identification. In the event that the entered identification is recognized, the computer will store the selection as to comfort level and timely provide the stored results to a network computer. The network computer is operative to analyze the comfort level information from these computers and send one or more commands to the HVAC system providing conditioned air to the locations.

In an exemplary preferred embodiment, individuals may select one of three different levels of comfort at their respective computers. The computers are grouped in accordance with the control of conditioned air to a particular location. Information from each of the computers is gathered and analyzed by a network computer which produces preferred levels of comfort for each location. This information as to preferred levels of comfort for each location is sent to an HVAC system control with damper controls that govern the flow of conditioned air to the various locations. The disclosed exemplary embodiment deals with levels of comfort for temperature in a location. The invention is, however, equally applicable to other measurements of comfort that may be analyzed and thereafter acted upon, including for instance, humidity or air flow.

BRIEF DESCRIPTION OF THE DRAWINGS

Further advantages of the present invention will be apparent from the following detailed description in conjunction with the accompanying drawings, wherein.

DESCRIPTION OF THE PREFERRED EMBODIMENT

Figure 1:
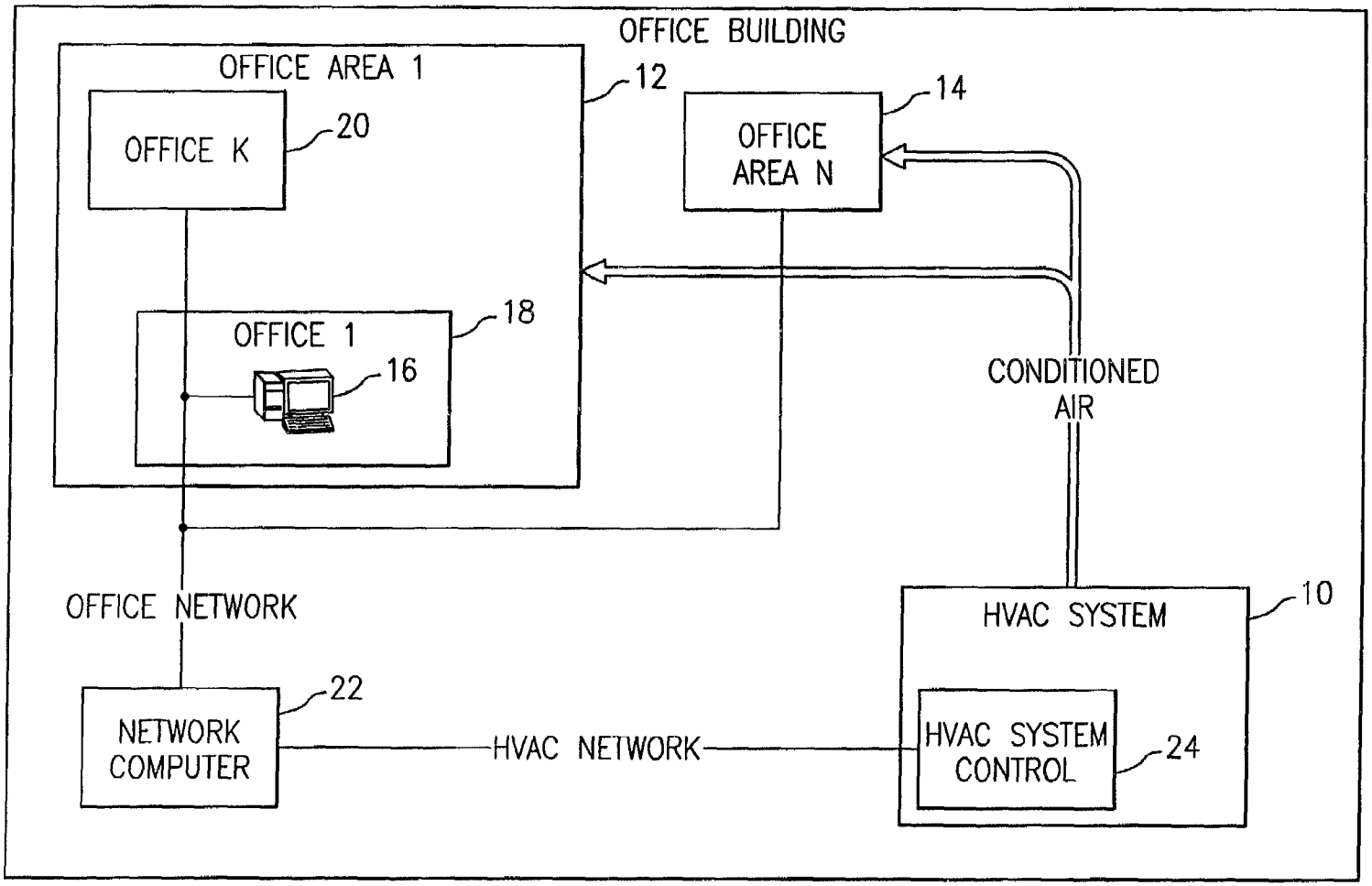
FIG. 1 illustrates an office building with a number of offices grouped into a number of office area locations.

Referring to FIG. 1, an HVAC system 10 provides conditioned air to a number of individual office area locations such as office area location 12 and office area location 14. Each office area location will carry a particular office area index value for purposes of identifying comfort level data originating from the particular office area location. This is indicated by office area location 12 being office area 1 whereas office area location 14 is identified as office area N.

Each office area location is seen to include a number of individual personal computers such as computer 16 located in an office 18. Each office within office area location 12 is identified by an office index "K" where K=for instance 1 for office 18 and is for instance another value for office 20.

Each computer within an office in a particular office area location is preferably connected to a network computer 22. As will be explained in detail hereinafter, the network computer 22 is operative to collect comfort level information entered in each of the computers within the individual offices of each office area location. The collected information is analyzed by particular office area index value. The network computer is thereafter operative to generate overall indications as to level of comfort in each office area. These overall indications as to comfort level are preferably indexed in accordance with the office area index and provided to an HVAC system control 24. The HVAC system control 24 is operative to control the HVAC system 10 so as to provide appropriate amounts of conditioned air to each of the office areas in accordance with the information received from the network computer 22.

Figure 2:
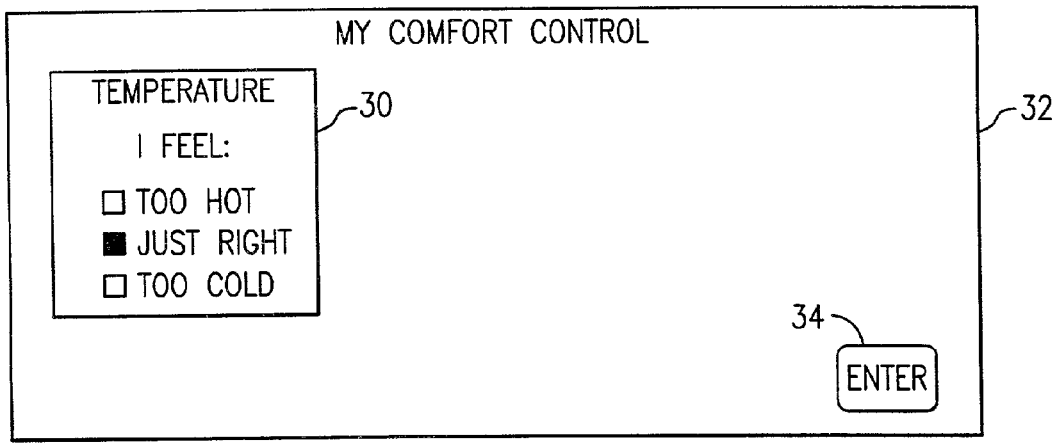
FIG. 2 illustrates a display menu as to comfort levels appearing on the screens of computers in the offices of FIG. 1.

Referring now to FIG. 2, a comfort level menu 30 appearing on the screen 32 of an office computer such as office computer 16 is shown. The comfort menu 30 preferably includes three levels of comfort for the temperature in the office in which the computer is located. These comfort levels are expressed as "TOO HOT", "JUST RIGHT", or "TOO COLD". The office computer preferably includes a point and click operating system which allows the user to click on the particular comfort level being experienced by the occupant of the office. The occupant of the office thereafter preferably clicks on an icon 34 labeled "ENTER" after making his or her selection as to comfort level from the menu 30.

Figure 3:
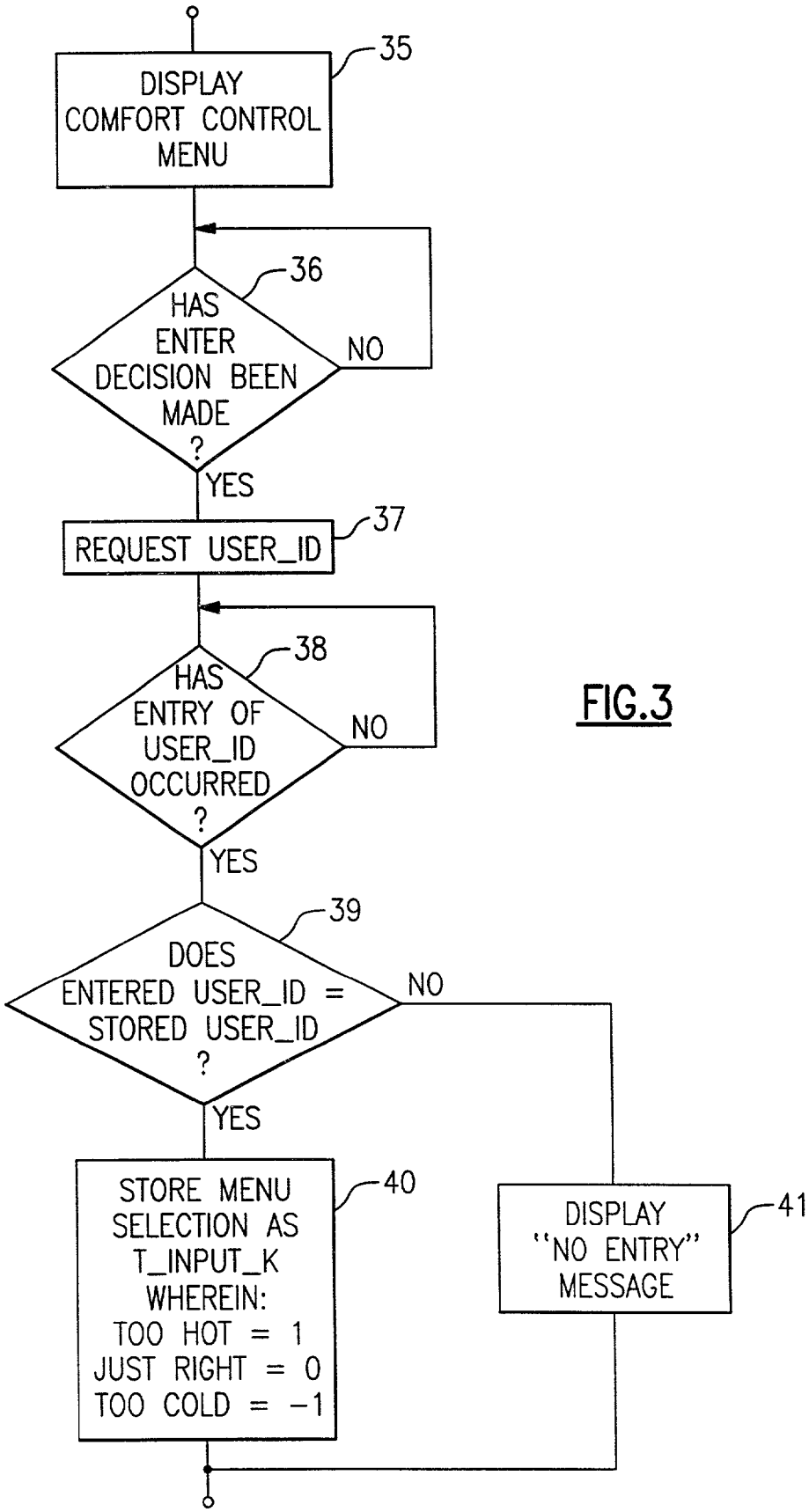
FIG. 3 illustrates a program located in the computers which generate the display menu of FIG. 2.

Referring now to FIG. 3, the software routine executed by a processor within each office computer is shown. The routine begins with a step 35 wherein a comfort control menu is displayed on the computer screen of the office computer. The comfort control menu could be the particular comfort control menu 30 of FIG. 2. The processor proceeds to a step 36 and inquires as to whether an "ENTER" decision has been made. An "ENTER" decision will have been made when a person clicks upon the "ENTER" icon 34 appearing on the computer screen 32 in FIG. 2. When an "ENTER" decision has been made, the processor proceeds from step 36 to a step 37 and issues a request on the screen of the office computer for a user identification. The processor awaits the entry of the user identification in step 38 before proceeding to a step 39 and inquiring as to whether the entered user identification compares favorably with one or more stored user identifications. The stored user identifications are preferably stored in a memory associated with the processor in the office computer. These stored user identifications have preferably been previously entered in accordance with a routine that permits the entry of such identifications. This routine may itself require one or more interactive communications requiring the user to first enter a key or code that allows them to proceed to enter their own unique user identification. In this manner, only people who are normally occupants of the location will be given a key or code that would allow them to store their own unique user identification. In any event, if the entered user identification noted in step 38 compares favorably with the previously stored identification in step 39, then the processor will proceed to store the menu selection made from the displayed menu of step 35. For a menu selection made from the menu 30, the processor preferably stores the selection as "T_INPUT_K". The value of "K" within the stored menu selection variable "T_INPUT_K" will be the office index value for the particular office in which the office computer is located. The stored menu selection in "T_INPUT_K" is preferably 1 for a comfort level selection of "TOO HOT", 0 for a comfort level selection of "JUST RIGHT", and −1 for a comfort selection of "TOO COLD". Referring again to step 39, in the event that the entered user identification does not compare favorably with the previously stored user identification, then the processor proceeds to display a message in step 41 that entry of the menu selection has been denied.

Figure 4:
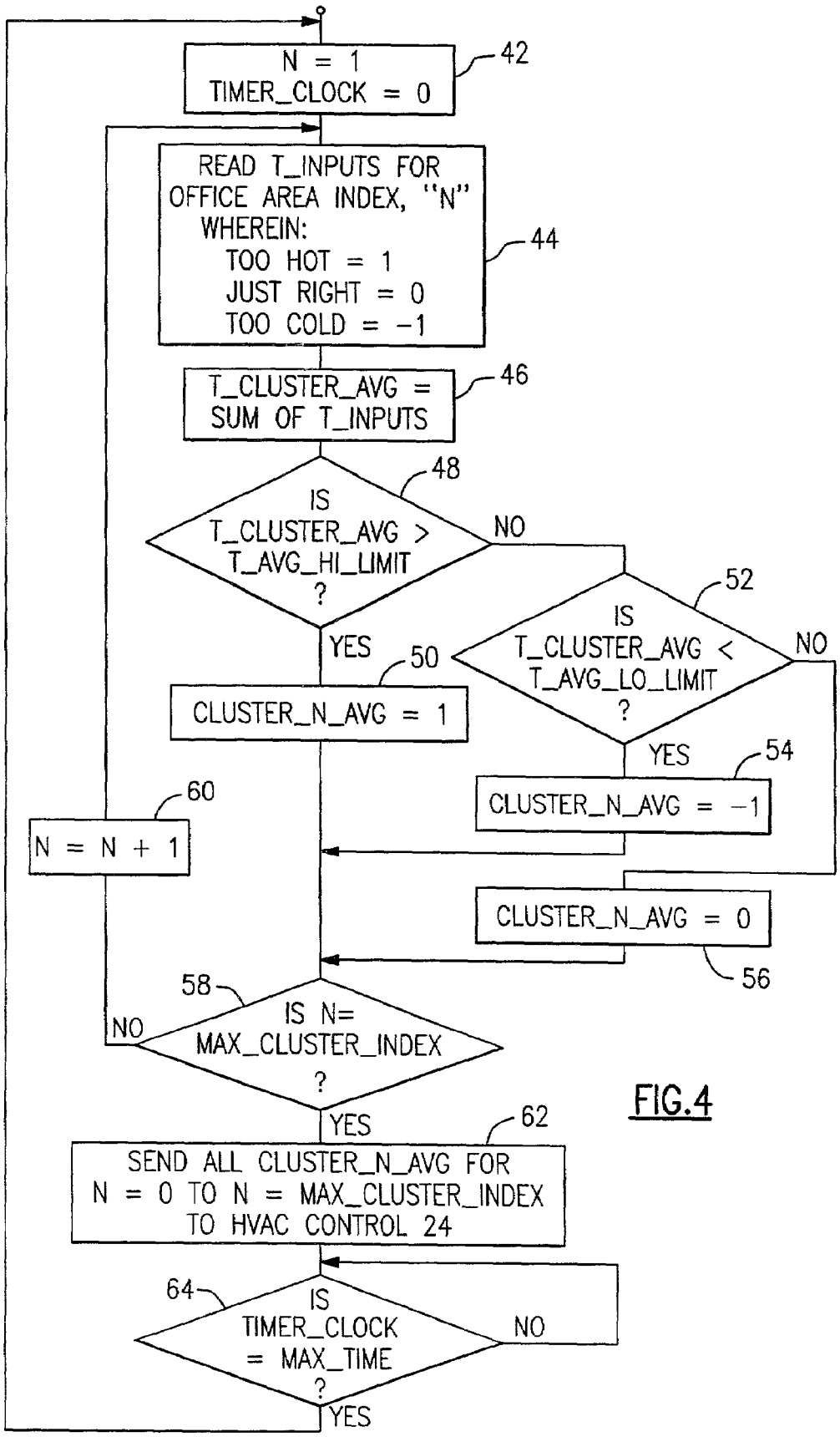
FIG. 4 illustrates a program located on a network computer which collects and analyzes the menu selections entered into the programmed computers in the offices of FIG. 1.

Referring now to FIG. 4, the computer program implemented by the processor within the network computer 22 is shown. The program begins with a step 42 wherein the office area index, "N" is set equal to 1. A "TIMER_CLOCK" is also set equal to 0 so as to thereafter begin clocking time from a system clock associated with the processor in the network computer. The processor proceeds to step 44 and reads "T_INPUTS" for the office area index, "N". Since "N" will be initially set equal to 1, the processor will be reading the menu selections for the office computers in office area 12. The processor will preferably read each stored menu selection, "T_INPUT_K" for the particular office computer in the office area 12. It will be remembered that the value of the stored menu selection will be 1 if the comfort level selection was "TOO HOT", 0 if the comfort level selection was "JUST RIGHT", and −1 if the comfort level selection was "TOO COLD". The processor will proceed to a step 46 and compute the value of a variable "T_CLUSTER_AVG". The value of this variable is equal to the sum of the read "T_INPUTS" in step 44. The processor will proceed to a step 48 and inquire as to whether the value of "T_CLUSTER_AVG" is greater than the value of a variable "T_AVG_HI_LIMIT". It is to be understood that the value of "T_AVG_HI_LIMIT" will be predefined for the particular office building or even office area under review. In this regard, assuming that there are ten office computers in each office area of the office building, then the value of "T_AVG_HI_LIMIT" could be equal to 5. This would require that the net sum of T_INPUTs would have to be greater than 5 in step 48 in order for the processor to proceed to a step 50. It is, of course, to be appreciated that the value of "T_AVG_HI_LIMIT" could be set lower so as to not require that so many stored menu selections be equal to 1. Referring to step 50, in the event that "T_CLUSTER_AVG" is greater than "T_AVG_HI_LIMIT", then the processor sets the variable "CLUSTER_N_AVG" equal to 1. The value of "N" in this variable will equal the current office area index value. This variable will therefore be an overall indication as to the comfort level in the office area indicated by the index value "N". This overall indication would be "TOO HOT" out of step 50.

Referring again to step 48, in the event that "T_CLUSTER_AVG" is not greater than "T_AVG_HI_LIMIT", then the processor will proceed along a no path to a step 52. Referring to step 52, the processor will inquire as to whether "T_CLUSTER_AVG" is less than the value of "T_AVG_LOW_LIMIT". It is to be appreciated that the value of "T_AVG_LOW_LIMIT" will be set for all office areas in the office building or for the particular office area then under review. This value will again be set so as to require that the net sum of "T_INPUTS" is predominantly negative so as to indicate a predominance of "TOO COLD" having been selected from the menu 30 on each screen of an office computer within the office area indicated by the index "N". For instance, this variable may be set equal to −3, −4, or even −5 for an office area including ten separate office computers. In the event that "T_CLUSTER_AVG" is less than the value of "T_AVG_LO_LIMIT", then the processor will proceed from step 52 to a step 54 and set "CLUSTER_N_AVG" equal to −1. This will be an overall indication that the office area having an office area index equal to the current value of N is too cold.

Referring again to step 52, in the event that "T_CLUSTER_AVG" is not less than "T_AVG_LO_LIMIT", then the processor will proceed to step 56 and set "CLUSTER_N_AVG" equal to 0, wherein the value of "N" will be the particular value of the office area index. This will be an overall indication that the temperature level is "JUST RIGHT" for the particular office area.

The processor proceeds from either step 50, step 54, or step 56 to a step 58 and inquires as to whether the office area index "N" is equal to "MAX_CLUSTER_INDEX". The value of "MAX_CLUSTER_INDEX" will be equal to the highest value of the office area index identifying the last office area to be analyzed. In the event that the value of the office area index "N" is not equal to "MAX_CLUSTER_INDEX", then the processor will proceed to a step 60 and increment the office area index "N" by one before returning to step 44. It is to be understood that the processor within the network computer will again execute steps 44–58 so as to determine the overall indication of comfort for the office area indicated by the new value of office area index "N". This will be stored in the new "CLUSTER_N_AVG". The value of the office area index "N" in the variable "CLUSTER_N_AVG" will identify the particular office area to which the overall comfort level indication applies.

Referring again to step 58, it will be understood that at some point, all office areas will have been analyzed and all overall comfort level indications will have been defined in respective values of "CLUSTER_N_AVG". When this occurs, the processor will proceed to a step 62 and send all CLUSTER_N_AVGs for N=0 to N=MAX_CLUSTER to the HVAC system control 24. The processor will proceed to step 64 and inquire as to whether the value of "TIMER_CLOCK" equals "MAX_TIME". The value of "MAX_TIME" will be arbitrarily set for the particular office building or office area under examination. In either case, the "TIMER_CLOCK" must exceed the "MAX_TIME" in order for the processor to proceed back to step 42 and again begin to collect the comfort level selections that have been made and stored as "T_INPUT_K" for each office computer in the first office area having an office area index value of 1. The menu sections from all such office computers will again be analyzed and an overall comfort level indication for each particular office area will be defined in CLUSTER_N_AVG before proceeding to the next office area. When all such office areas have been analyzed, the overall comfort level indications for each office area will be forwarded to the HVAC control 24 again in step 62.

Figure 5:
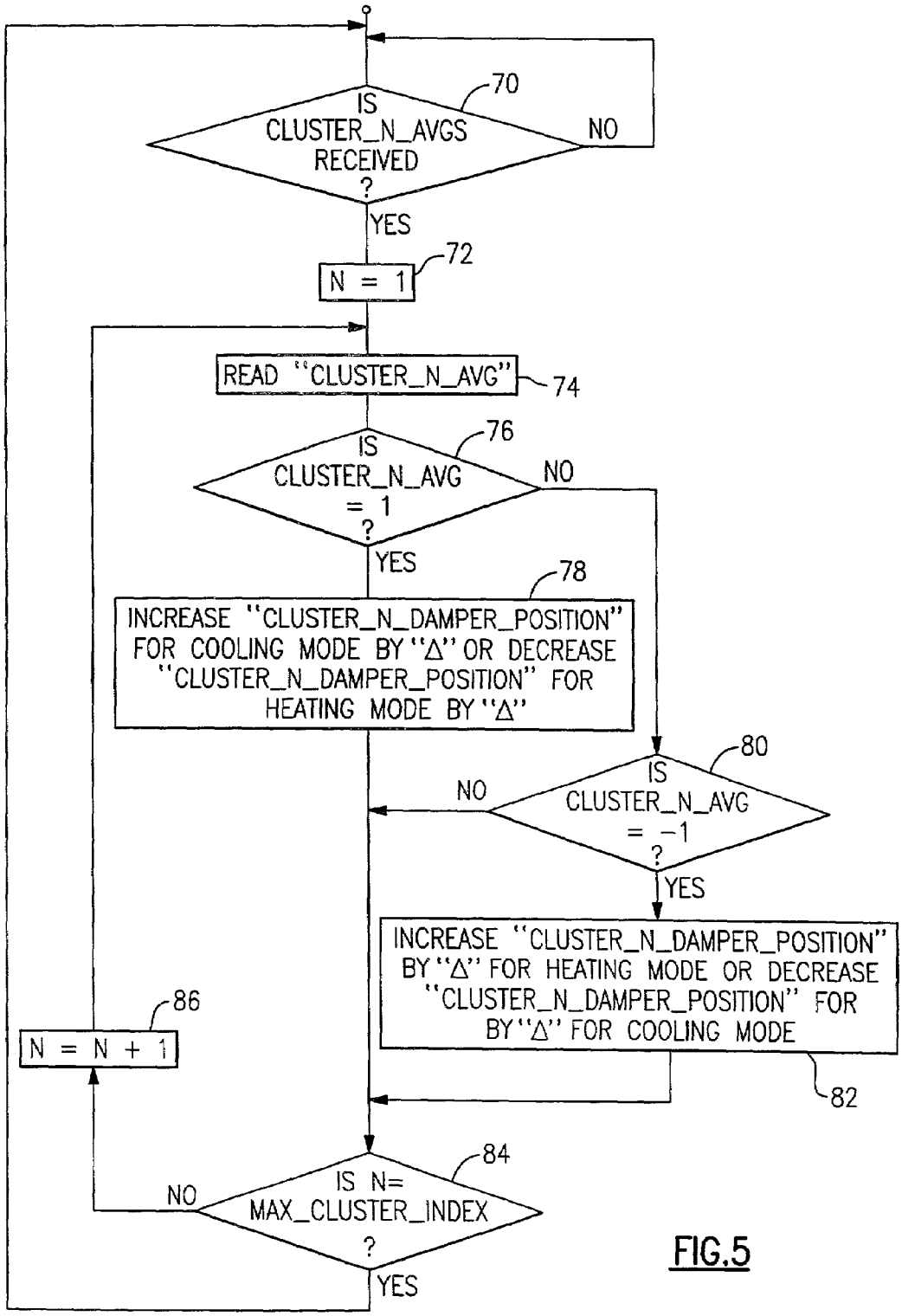
FIG. 5 illustrates an exemplary program that may be executed by a processor within an HVAC system control in response to one or more commands from the network computer executing the program of FIG. 4.

Referring now to FIG. 5, an exemplary program or process is set forth that could be implemented in the HVAC system control 24. The exemplary program could be used in response to the overall comfort level indications for each office area that are sent by the network computer 22. The program or process begins with a processor within the HVAC system control implementing a step 70 wherein inquiries made as to whether all "CLUSTER_N_AVG" values have been received from the network computer 22. When this occurs, the processor proceeds to step 72 and sets the office area index "N" equal to 1. The processor next reads "CLUSTER_N_AVG" for the current index value of "N". The processor proceeds to step 76 and inquires as to whether the read "CLUSTER_N_AVG" of step 74 is equal to one. If it is, the processor will proceed to a step 78.

Referring to step 78, it will be assumed that the HVAC system 10 of FIG. 1 includes damper position controls for each office area within the office building. In such a system employing damper control, the processor will, in step 78, increase a "CLUSTER_N_DAMPER_POSITION" by a predefined amount "Δ" for a cooling mode of operation of the HVAC system. On the other hand, the processor will decrease the same "CLUSTER_N_DAMPER_POSITION" by the incremental amount "Δ" for a heating mode. This will thereby provide more cool air to an office area that has indicated that the office area is too hot or it will decrease the amount of heated air provided in the event that the HVAC system is in a heating mode of operation. Referring again to step 76, in the event that the overall comfort level indication for temperature in the particular office area is not equal to one, then the processor will proceed to step 80 and inquire as to whether "CLUSTER_N_AVG" is equal to −1. In at the event that it is, the processor will proceed along a yes path to step 82 and increase the value of "CLUSTER_N_DAMPER_POSITION" by the incremental amount "Δ" when in a heating mode or decrease this damper position variable by "Δ" for a cooling mode. This will have the effect of providing A more heated air for an office area that has an overall comfort level indication of being too cold during the heating mode or decreasing the amount of cooled air provided to the same location in the event that the HVAC system is in a cooling mode. The processor will proceed from having either increased or decreased the damper position variable in step 82 to a step 84.

Referring to step 84, it is to be appreciated that this step will be encountered after execution of either step 78, step 82 or step 80. Referring to step 80 the processor proceeds along the no-path out of step 80 when the overall comfort level indication for temperature for the particular office area is neither equal to 1 or −1. The overall comfort level indication for temperature will in this case be 0 indicating that the overall comfort level is just right. The processor will, in step 80, inquire as to whether the value of the office area index "N" equals the value of "MAX_CLUSTER_INDEX". It will be remembered that the value of "MAX_CLUSTER_INDEX" is equal to the highest value of the office area index. This would identify the last office area having an overall comfort level value to be processed. In the event that the processor has not processed the last overall comfort level value for the last office area, the processor will proceed along the no-path and increment the office area index "N" by one in a step 86. The processor will proceed back to step 74 and read the "CLUSTER_N_AVG" for the office area having the newly defined office area index value. The overall comfort level value for temperature for this particular office area will be analyzed and the damper position variables will be appropriately incremented or decremented as has been previously described. At some point the overall comfort level indications for all office area will have been processed again. At this point, the processor will proceed out of step 84 along the yes path back to step 70. The processor will again await receipt of a new set of overall comfort level indications for the office areas before proceeding to analyze each such overall comfort level indication and again, set the damper positions in steps 72 through 86.

Figure 6:
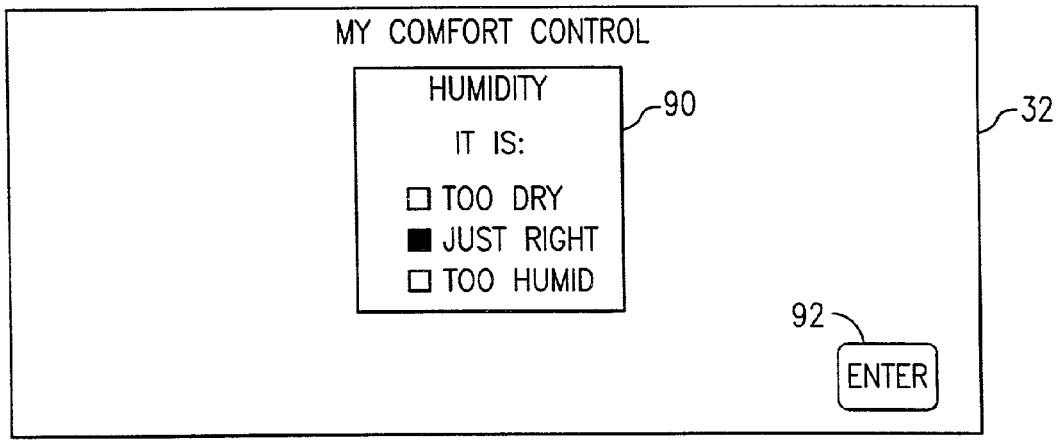
FIG. 6 illustrates the display of an alternative comfort level menu to that of FIG. 2.

Referring now to FIG. 6, an example of an alternative menu that could be displayed on each office computer is shown. The comfort control menu 90 is with respect to humidity. In this regard, the occupant of the room is invited to select between "TOO DRY", "JUST RIGHT" and "TOO HUMID". The occupant clicks on the ENTER icon 92 when the selection has been made. The network computer will analyze the comfort level values for each office computer regarding humidity in much the same manner as been heretofore described with respect to the comfort control for temperature in FIG. 2. The humidity for the particular office area will either be adjusted upwardly or downwardly or no change made to it depending on the overall comfort level indication for the particular office area. This can be done either by dedicated humidifiers in the air flow paths to the particular office areas or it could be done at the central location of the HVAC system. In the latter case, all comfort level indications as to humidity for all office areas would have to be analyzed before determining whether or not to adjust any centrally located humidifier. In this latter instance, if the overall humidity is to be raised, and one or more of the offices, in fact, indicated that they wanted less humidity, then the dampers could be controlled in conjunction with the new raised humidity level for office areas indicating that the comfort level for humidity was already too high.

It is to be appreciated from the above that a number of programs resident in processors within an office computer, a network computer, and an HVAC system control have been disclosed. Alterations, modifications and improvements to these various individual programs may readily occur to those skilled in the art. For instance, the particular comfort control menu may vary as to how it is displayed as well as how many particular comfort level selections may be made. Furthermore, the processor program executed by the network computer could compute the overall comfort level indications for each particular office area in a different manner. This could include summing all comfort level values provided by the office computers and dividing by the number of computers in the particular office area. This could thereafter be compared with an appropriate high and low limit for such a computed average before setting the particular overall comfort level indication for that particular office area. The network computer program could furthermore require several distinct samplings of the comfort levels from each office computer with resulting computations as to overall comfort level indications before arriving at a particular overall comfort level indication average that is to be used for that particular area. It is to be furthermore understood that the particular program implemented by an HVAC system control downstream of the network computer could vary considerably depending on the HVAC system that is to be controlled and the particular overall comfort level indication that is to be responded to. In this regard, an alternative to temperature comfort could be the humidity in each office area. Accordingly, the foregoing description of the particular programs in the preferred embodiment is by way of example only and the invention is to be limited by the following claims and equivalents thereto.

What is claimed is:

1. A process for collecting information to control one or more systems that provide conditioned air to a plurality of locations, said process comprising the steps of:

providing for an entry of at least one level of comfort in a plurality of data entry devices at each location;

requiring that the entry of at least one level of comfort at each data entry device be accompanied by an entry of an identification of a person making the entry of comfort level; and verifying that the entered identification is recognized by the data entry device.

2. The process of claim 1 wherein said step of verifying that the entered identification is recognized comprises the step of:

comparing the entered identification with at least one previously stored identification to determine whether the entered identification matches the previously stored identification.

3. The process of claim 2 wherein said step of providing for the entry of at least one level of comfort in a plurality of data entry devices comprises the step of generating a menu of different comfort levels that may be selected at each data entry device, and wherein said process further comprises:

storing at least one comfort level that is selected in the data entry device when the entered identification matches a previously stored identification.

4. The process of claim 1 wherein said step of providing for the entry of at least one level of comfort in a plurality of data entry devices comprises the step of generating a menu of different comfort levels that may be selected at each data entry device; and wherein said process further comprises:

storing at least one comfort level that is selected in the data entry device when the entered identification is recognized.

5. The process of claim 1 further comprising the steps of: collecting information as to the levels of comfort entered at the data entry devices at each location that are accompanied by an entered identification that is recognized by the data entry device;

determining the overall level of comfort for particular groupings of data entry devices from the collected information as to the levels of comfort entered into the data entry devices; and transmitting indications as to an overall level of comfort for the particular groupings of data entry devices to at least one system that provides conditioned air to the plurality of locations.

6. The process of claim 5 wherein said step of collecting information as to the levels of comfort entered at the data entry devices at each location comprises the step of:

collecting information as to the levels of comfort entered at the data entry devices by the particular location in which the levels of comfort were entered whereby the overall level of comfort for a particular grouping of data entry devices is determined with respect to the collected information at the particular location.

7. The process of claim 5 wherein said step of determining the overall level of comfort for particular groupings of data entry devices comprises the steps of: computing an overall level of comfort for each particular grouping of data entry devices;

determining whether the computed level of comfort for each particular grouping of data entry devices exceeds a threshold value for assigning a particular overall level of comfort; and assigning a particular level of comfort for each particular grouping of data entry devices when the computed level of comfort exceeds the threshold value.

8. The process of claim 5 wherein each particular grouping of data entry devices is provided with a unique identifier and wherein said step of determining the overall level of comfort for each particular grouping of data entry devices comprises the step of:

computing an overall level of comfort for each particular grouping of data entry devices as a function of the information collected as to the levels of comfort entered at the data entry devices having the unique identifier for each particular grouping of data entry devices.

9. The process of claim 1 wherein each data entry device is a personal computer.

10. A system for providing conditioned air to a plurality of locations, said system comprising:

a plurality of data entry devices at each location, each data entry device being operative to provide for a selection of at least one level of comfort at a location, each data entry device being furthermore operative to require that the selection of at least one comfort level be accompanied by the entry of an identification of the person using the data entry device;

at least one computer in communication with the plurality of data entry devices, said computer being operative to collect information as to the selections of comfort level entered at the data entry devices that are accompanied by a verified entry of an identification of the person using the device and being furthermore operative to determine overall levels of comfort for each location from the collected information; and at least one HVAC control being operative to control the provision of conditioned air to the locations in response to the determination of overall levels of comfort for each location.

11. The system of claim 10 wherein each data entry device is operative to generate a menu of different comfort levels that may be selected and entered at each data entry device.

12. The system of claim 11 wherein each data entry device is operative to store the entry of a particular comfort level from among the different comfort levels in the menu when the identification of a user is verified by the data entry device.

13. The system of claim 12 wherein each data entry device is operative to provide the stored entry of a particular comfort level to the at least one computer in communication with the plurality of data entry devices.

14. The system of claim 10 wherein each data entry device is a personal computer.

15. A system for providing conditioned air to at least one location, said system comprising:

a plurality of data entry devices at the location, each data entry device being operative to provide for a selection of at least one level of comfort at the location, each data entry device being furthermore operative to require that the selection of at least one comfort level be accompanied by the entry of an identification of a person using the data entry device; at least one computer in communication with the plurality of data entry devices, said computer being operative to collect information as to the selections of comfort level entered at the data entry devices that are accompanied by a verified entry of an identification of the person using the device and being furthermore operative to determine an overall level of comfort for the location from the collected information; and at least one HVAC control being operative to control the provision of conditioned air to the location in response to the determination of an overall level of comfort for the location.

16. The system of claim 15 wherein each data entry device is operative to generate a menu of different comfort levels for a selection of one of the different comfort levels by a user of a particular data entry device.

17. The system of claim 16 wherein each data entry device is operative to store the selection of a particular comfort level from among the different comfort levels in the menu provided that the identification of the person using the data entry device is verified.

18. The system of claim 10 wherein each data entry device is a personal computer.

* * * * *